US010062276B2

(12) United States Patent
Hawkins et al.

(10) Patent No.: US 10,062,276 B2
(45) Date of Patent: Aug. 28, 2018

(54) REMOTE CONTROL DEVICE AND CONTROLLER

(71) Applicant: AUTOMATIC TECHNOLOGY (AUSTRALIA) PTY LTD, Keysborough (AU)

(72) Inventors: Ray Hawkins, Keysborough (AU); Geoff Baker, Keysborough (AU)

(73) Assignee: AUTOMATIC TECHNOLOGY (AUSTRALIA) PTY LTD, Victoria (AU)

( * ) Notice: Subject to any disclaimer, the term of this patent is extended or adjusted under 35 U.S.C. 154(b) by 0 days.

(21) Appl. No.: 14/913,011

(22) PCT Filed: Aug. 19, 2014

(86) PCT No.: PCT/AU2014/050192
§ 371 (c)(1),
(2) Date: Feb. 19, 2016

(87) PCT Pub. No.: WO2015/024074
PCT Pub. Date: Feb. 26, 2015

(65) Prior Publication Data

US 2016/0203705 A1 Jul. 14, 2016

(30) Foreign Application Priority Data

Aug. 19, 2013 (AU) ..... 2013903135

(51) Int. Cl.
*G08C 23/04* (2006.01)
*G08C 17/02* (2006.01)

(52) U.S. Cl.
CPC ..... *G08C 23/04* (2013.01); *G08C 17/02* (2013.01)

(58) Field of Classification Search
None
See application file for complete search history.

(56) References Cited

U.S. PATENT DOCUMENTS

| | | | | |
|---|---|---|---|---|
| 3,366,855 | A | 1/1968 | Huber et al. | |
| 4,316,273 | A | 2/1982 | Jetter | |
| 6,795,011 | B1 | 9/2004 | Berthoud et al. | |
| 7,154,566 | B2 * | 12/2006 | Gustafson | G08C 19/28 348/734 |
| 7,429,932 | B1 * | 9/2008 | Newell | G08C 17/00 340/12.24 |
| 7,902,759 | B2 | 3/2011 | Newman, Jr. | |

(Continued)

OTHER PUBLICATIONS

PCT, International Search Report and Written Opinion, PCT/AU2014/050192, dated Oct. 2, 2014.

(Continued)

*Primary Examiner* — Brian Miller
(74) *Attorney, Agent, or Firm* — Morgan, Lewis & Bockius LLP

(57) ABSTRACT

The present invention relates to a remote control device (10), comprising one or more command buttons, each of which, when operated, directly or indirectly generates a command signal. The device includes a determination module (20) for determining a button-held-time parameter associated with the operation of a command button; and a transmitting module (18) that is configured to transmit the button-held-time parameter in association with the command signal.

12 Claims, 1 Drawing Sheet

(56) References Cited

U.S. PATENT DOCUMENTS

| | | | | |
|---|---|---|---|---|
| 8,144,120 | B2 | 3/2012 | Vassigh et al. | |
| 2003/0073461 | A1 | 4/2003 | Sinclair | |
| 2003/0123840 | A1* | 7/2003 | Fujinami | H04N 5/765 386/234 |
| 2005/0184854 | A1* | 8/2005 | Mullet | G07C 9/00182 340/5.22 |
| 2006/0232377 | A1* | 10/2006 | Witkowski | G08C 19/28 340/5.25 |
| 2012/0212339 | A1 | 8/2012 | Goldblatt | |
| 2013/0020969 | A1 | 1/2013 | Leivenzon | |
| 2013/0204461 | A1 | 8/2013 | Kartes | |

OTHER PUBLICATIONS

Burke, Dave; Speech Processing for IP Networks, Media Resource Control Protocol (MRCP); 2007 John Wiley & Sons Ltd. The Atrium, Southern Gate, Chichester, West Sussex, PO19 85Q, England—pp. 106-107.

* cited by examiner

REMOTE CONTROL DEVICE AND CONTROLLER

FIELD OF THE INVENTION

The invention relates to command signal transmission, and more specifically to a remote control device that is suitable for transmitting command signals to a controller, such as a garage door controller. The invention also relates to a controller, such as a garage door controller, that includes a receiver and processing means for processing command signals received from a remote control device.

BACKGROUND TO THE INVENTION

Any discussion of documents, acts, materials, devices, articles and the like in this specification is included solely for the purpose of providing a context for the present invention. It is not suggested or represented that any of these matters formed part of the prior art base or were common general knowledge in the field relevant to the present invention as it existed in Australia or elsewhere before the priority date of each claim of this application.

Remote control devices for garage door controllers have been in use for many years. Such devices are typically handheld units and include one or more buttons for issuing commands and in some cases, adjusting various controller settings. Remote control devices further include processing circuitry for sensing button pushes, and a transmitter for generating a suitable transmission signal (commonly an infa-red signal, or alternatively a radio frequency, Bluetooth or WIFI signal) to communicate to the controller information regarding the button pushed. The garage door controller includes a receiver that receives the transmission signal and processes the button information transmitted therein. The controller's response to the button push is dependent both on the identity of the button (where the device has a plurality of buttons) and the function assigned to the button, as well as the controller's current mode of operation.

For security reasons, signal transmissions from remote control devices for garage door controllers are encoded with a unique code that identifies the transmitter and permits the transmitter to communicate with the receiver. The receiver must be specifically coded before being used for the first time and then each time it is to be used with a new transmitter. A typical coding process involves placing the receiver in a 'code-set state', in which state the receiver accepts any transmission that it detects A specified remote control function is assigned to the transmitter button's unique code, which is stored in the controller's local memory as a 'permitted' transmitter, whose transmissions are to be received and actioned.

The code-set state is typically entered by pushing a button for similar device) on the receiver (for an 'attended code set state'), or by pushing a button on the remote control that has been assigned in a previous coding operation as activating a code set state (for a 'remote code set state').

When the receiver is in a code-set state (and thus receiving all detected transmissions), there is a risk of the receiver being unable to distinguish between transmissions received from the intended transmitter (i. e the transmitter being coded) and those received from a foreign transmitter that is wholly unrelated to the coding operation. The risk is managed in some receivers by imposing a requirement that two transmissions must be detected before any action is taken in response to the receipt of the transmission. Although this does reduce the likelihood of an imperfect coding of a correct transmitter, it does not eliminate the possibility of an incorrect transmitter being coded, should that unintended transmitter be operated twice during the code setting period.

Coding an incorrect transmitter to a receiver can be very inconvenient, especially when the transmitter cannot easily be deleted from the receiver's memory. In these circumstances, it is usually necessary for the user to delete all transmitters from the receiver's memory and to re-code the correct transmitter or transmitters.

Transmitters that are to be coded can be placed in a special state that allows a code-set transmission to be communicated to the receiver. However, equipping remote controls with the necessary functionality to enter the special state is not generally desirable, due to the requirements for additional circuitry for mode switches, indicators arid power control. It also requires additional steps to be undertaken by the user during the code set procedure. For these reasons, such measures are relatively rarely implemented.

It is known to use selected buttons on remote control transmitters to 'toggle' a receiver's output. The arrangement is often used, for example, to turn on and off remote control lights or to turn ON and OFF various modes of operation. Typically, the remote control output changes state in sequence, each time a transmitter button assigned to the remote control function is pressed. However, a problem arises when the user is unable to determine the current state of the remote control's output and thus does not know whether the output is turned ON or OFF. The user is therefore unable to predict the result of the next press of the transmitter button. One solution is to assign ON and OFF commands to two different buttons on the remote control, however the approach necessarily entails a reduction in the number of devices that can be controlled, or the number of functions that can be implemented.

Another limitation of existing remote control devices is their failure to allow a user to communicate a clear intention to operate a particular remote control function. For example, in the context of a remote control device for a garage door controller, it is apparent that a user's operation of the remote control to dose the garage door should require a greater demonstration of intent in comparison to other operations, such as to open the garage door. This is because the consequences of an accidental push of the remote control button causing the door to close are potentially more hazardous to persons in the vicinity of the door than the consequences of an unintended door opening.

A further limitation of existing remote control devices is that they cease signal transmissions as soon as the relevant button is released, Although some remote control devices are configured to complete a transmission that is already underway, no indication is sent to the receiver that the button has been released. When the receiver processes transmissions in a way so as to generate an output that mimics the transmitter button press, the receiver must allow for missed transmissions due to possible interference. Failing to account for interference will result in the output turning off briefly when a transmission is not received and then on again when reception is reinstated. A known method of accounting for interference is to implement a timeout feature, whereby the receiver does not turn the output off until no transmissions have been received for a prescribed period, referred to as a 'timeout period'. However, timeouts have their own limitations, in that, in the absence of interference, the receiver maintains an output for a time longer than is required.

U.S. Pat. No. 6,795,011 describes a remote control device for a television with a 'help' features that provides information about the button that has been pushed. The feature is triggered by holding down the button for a very short period of time, or alternatively for a longer than usual period of time. In these scenarios, instead of the remote control actioning the pushed button, the system communicates help information to the user, either from the remote control device itself or from the controlled device (eg. displaying on the television screen).

The present invention aims to provide an alternative approach to addressing one or more of the deficiencies of existing remote control devices, receivers and control systems discussed above.

SUMMARY OF THE INVENTION

In broad terms, the invention provides a remote control device, comprising one or more command buttons, each of which, when operated, directly or indirectly generates a command signal, a determination module for determining a button-held parameter associated with the operation of a command button, and a transmitter module configured to transmit the button-held parameter in association with the command signal. The button-held parameter may be representative of a time the button is held or pressed, or may be representative of the state of the button (commonly, whether the button is being pressed or not).

More particularly, according to a first aspect of the present invention there is provided a remote control device, comprising:

one or more command buttons, each of which, when operated, directly or indirectly generates a command signal;

a determination module for determining a button-held-time parameter associated with the operation of a command button; and a transmitter module that is configured to transmit the button-held-time parameter in association with the command signal.

The remote control device according to the invention includes means for determining a button-held-time parameter associated with the operation of one or more of the device's command button. Button-held-time parameters, such as the length of time that a button is held and/or the number of times the button is pushed during a defined time interval, can be suitably determined by the determination module. The determination module can be conveniently equipped to make determinations of other categories of button-held-time parameter.

In this specification and claims, the word 'button' and 'button press' and similar are to be construed as embracing other forms of selective user control activation. For example, the 'button' may be a switch, joystick or other mechanical operator, whose selective movement into a certain position provides the required 'pressing', the amount of time it is held in that position indicating the 'button-held-time'. Alternatively, the 'button' may be a virtual button on a control touch screen, and pressing that button may involve the user clicking that virtual button, with a held time indicated by the length of time the user holds his or her finger on the button. Alternatively, the 'button' may be a swipe field on a touch screen, with the user swiping his or her finger along the swipe field providing the required 'pressing' of the 'button'. Again, a held tune can be indicated by the length of time the user holds his or her finger on the swipe field.

The button-held-time parameter may be a value modified after a prescribed time interval for which a button is held. Preferably the value is a count, sequentially incremented on regular intervals.

The button-held-time parameter is transmitted to a receiver associated with a controlled device (for example a garage door controller), at which the parameter is used to determine the command that the controlled device is to execute.

Embodiments of the invention in which the controlled device is a garage door controller are at less risk of having an incorrect remote control coded thereto. This is due to the controller being able to use the button-held-time parameter to discern a clear intention on the part of a user of the remote control device, to activate a critical command such as a command to code the device to the controller, or to close the garage door that is associated with the controller.

Preferably, the determination module is further configured to determine a button-held indicator indicating whether the command button has been released. In particularly preferred embodiments, the transmitter is further configured to delay transmission of the button-held-time parameter on the basis of the state of the button-held indicator. For example, the transmitter module may be configured only to transmit the button-held-time parameter if the button-held indicator indicates that the button has been released.

The button-held indicator may be a single bit, indicating either 'button held' or 'button clear'.

The feature of the button-held indicator provides accurate and timely information to the receiver with respect to when a button has been released. The receiver is thus able to respond immediately upon receipt of the information. In the absence of the button-held indicator, the receiver must be designed to rely on failure to receive transmissions for a prescribed time interval as the only indicator that the button had been released. As discussed above, the lack of receipt of a transmission could actually be due to interference.

Optimally, the transmitter module is configured to continue transmitting signals for a period of time after the button-held indicator indicates that the transmitter button has been released.

According to a second aspect of the present invention there is provided a controller comprising:

a receiver module for receiving and decoding signals transmitted from a remote control device, the signals including one or more commands and one or more button-held-time parameters; and an actuator module operatively connected to the receiver module, the actuator module being configured to implement selected functions on a controlled device, wherein the function selections are made on the basis of the received command(s) and button-held-time-parameter(s).

The received signals may further include a button-held indicator indicating whether a command button of the remote control device used to generate the command(s) has been released, the function selected by said actuator module being selected or modified on the basis of the button-held indicator, Transmissions with an ultimate button-held-time parameter (ie. the 'maximum time reached' parameter, if the parameter is a regularly incremented count, this will be the highest count value of a received sequence) may be received with and without the button-held indicator being set. This affords a check that the ultimate value received is indeed the ultimate value intended, as determined by the remote control device. This accounts for receiver interference, which may otherwise have interrupted the transmission According to another aspect of the present invention, there is provided a controller system comprising a remote control and a controller according to the first and second aspects of the invention.

The present invention takes a wholly different approach to the remote control system described. in U.S. Pat. No. 6,795,011. In particular, the activator module described in U.S. Pat. No. 6,795,011 is located in the transmitter, rather than the receiver. The decision as to which function is'to be commanded is made by the transmitter and not by the receiver. In contrast, a controller according to the present invention receives command signals and button-held-time parameters and makes decisions concerning function selections on the basis of both items of information.

Another distinction over the system described in U.S. Pat. No. 6,795,011 arises from the fact that the transmitter described in U.S. Pat. No. 6,795,011 is unable to generate transmissions until it has determined whether a BUTTON or HELP function is required. This is because, if transmissions were sent while a BUTTON/HELP determination was underway, it would result in the transmission of the BUTTON function until the HELP function was activated after the required button hold time. In practice, this would not prevent operation of the BUTTON function, as the receiver would have to respond to all functions it receives. It is not able to change its response based on button hold time as it does not include a help mode activator module. The transmitter does not send time information that progresses from transmission to transmission, as provided in accordance with the present invention. Even if the HELP function required a shorter triggering time it would still not prevent operation of the BUTTON function if continuous transmissions are generated, as initially the HELP function would be activated by the receiver (or transmitter) and then, after the required button hold time, the BUTTON function would be activated.

BRIEF DESCRIPTION OF THE DRAWINGS

Embodiments of the present invention will now be described, by way of example only with reference to the accompanying drawings, in which.

DETAILED DESCRIPTION OF THE DRAWINGS

Figure 1:
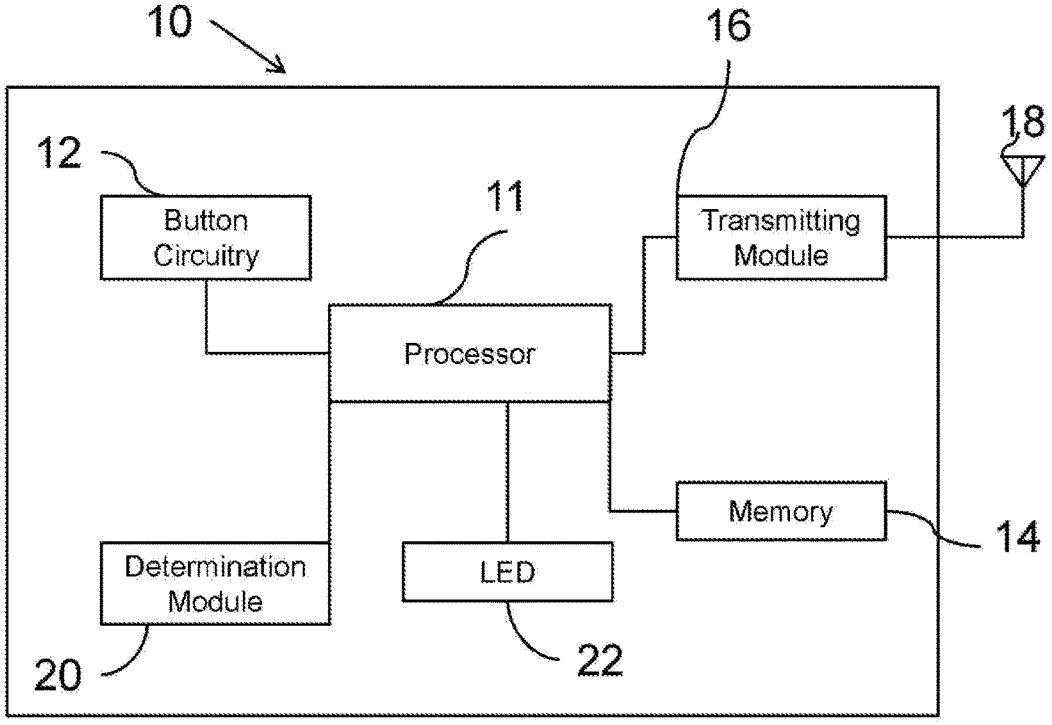
FIG. 1 is a schematic illustration of mote control device according to an embodiment of the present invention.

Turning to FIG. 1, a remote control device 10 is illustrated, for use in transmitting commands to a garage door opener. The operations of remote control device 10 are directed by processor 11 to execute a programmed operating procedure. Suitable software routines for implementing the operating procedure are stored in device memory 14.

Figure 2:
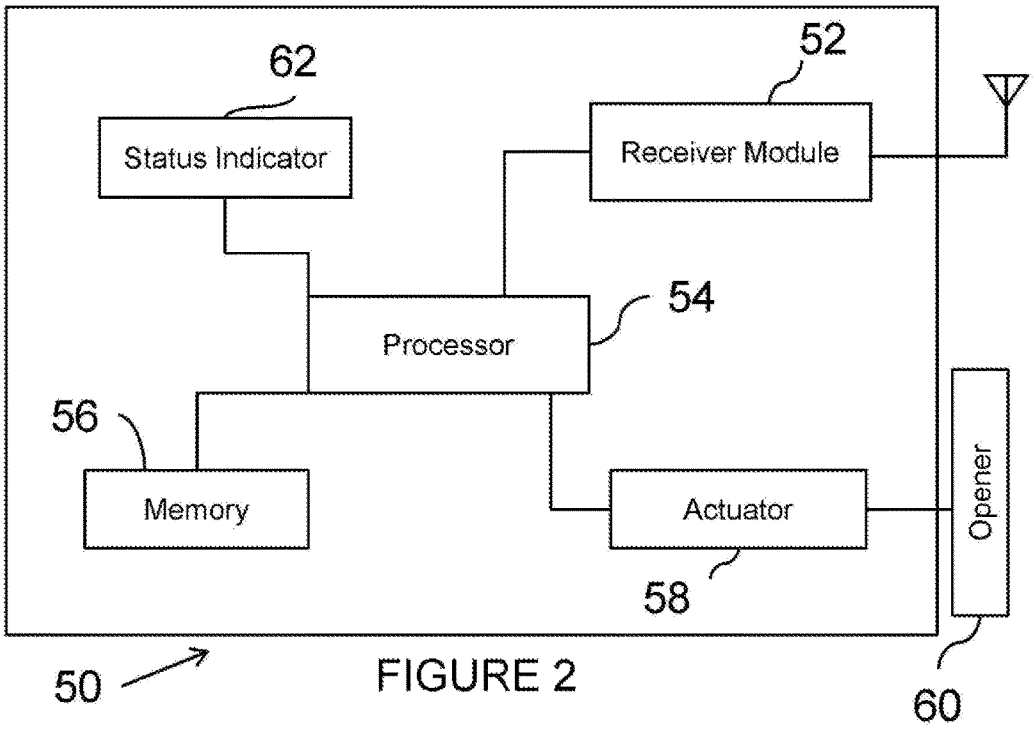
FIG. 2 is a schematic illustration of garage door controller according to an embodiment of the present invention.

The exterior appearance of remote control device 10 is not illustrated, but can be of any suitable form, and includes a plurality of command buttons (not shown), The buttons are pushed in order to send commands to a garage door controller 50 (FIG. 2), such as to open/close the garage door that is controlled by controller 50. As described in greater detail below, remote control device 10 is also selectively used to adjust various settings of garage door controller 50.

Remote control device 10 includes circuitry 12 for detecting button pushes and generating suitable signals that are indicative of the identity of the particular button that was pushed. These button-identifying signals are provided to a transmitting module 16, at which the signals are modulated onto a suitable carrier signal for transmission in the form of digital packets to controller 50. The carrier signal is sent by way a transmitter 18 and can be of any suitable form, including infrared, radio frequency, Bluetooth and WIFI. Transmitting module 16 continues to generate and send command packets at regular intervals (eg 100 ms intervals) while button circuitry 12 indicates that the button is pressed (and beyond—as discussed below).

Transmitting module 16 executes encoding routines to encode the signals in accordance with signal received front button circuitry 12, either before or after their modulation onto the carrier.

Remote control device 10 includes a determination module 20 that includes suitable circuitry for detecting the length of time that a button is pushed. This button-held-time parameter is recorded in memory 14 and provided to transmitting module 16 to enable the parameter to be transmitted along with the button-identifying signal.

The transmitter therefore sends a button-held-time parameter within each of its transmission data packets.

Determination module 20 causes the button-held-time parameter to be initialised in memory 14 to a value of 0 when the transmitter button is first pressed and button circuitry 12 activated. The value of the parameter is then incremented at a suitable rate until the transmitter button is released.

As will be dear to the skilled reader, the value of the parameter may diverge from the receiver 52's perception of button-held-time (being the time period for which a button-identifying signal is received). An equivalence of values assumes that the receiver receives all transmissions from a transmitter. However, this does not always occur, for example, in circumstances of marginal reception (for example due to interference), transmissions from a transmitter may not be received by the receiver (for example for the first one second of a transmission). Consequently, the receiver reception time calculation will be 1 second less than the actual time the button has been held (ie. as recorded by timing circuitry of determination module 20).

The unit of time selected for recording the button-held-time parameter is system-dependent, but it can be any suitable increment of time that changes from transmission to transmission.

In addition to transmitting the button-held-time parameter, transmitting module 16 transmits a button-held indicator (in the form of a status bit) which indicates whether the button which initiated the transmissions is being held.

Transmitting module 16 continues to generate transmissions which include the above information for a period of time after the button is released. These post-release transmissions include:

- button-held indicator set to 'clear' (ie. indicating button has been released); and
- button-held-time parameter set to the maximum time reached before the button was released.

The duration of post-release transmissions is system-dependent and can also be modified based on the button-held-time parameter reached. These transmissions ensure that the receiver determines that the user has released the transmitter button, rather than the receiver assuming that the button has been released when it no longer receives transmissions. This is turn provides a more accurate picture of the operation of remote control device 10, as an absence of transmissions may be due to receiver interference rather than as a result of the button being released.

When a command is being send, therefore, every time a packet is sent (for example, every 100 ms), the same data is sent, except for any changes in the button-held-time parameter and the button-held indicator.

In a further embodiment, the invention may be implemented without the transmission of a button-held-time parameter, but including only the button-held indicator (in addition to the command data and other payload).

Remote control device 10 is suitably equipped with a transmitter status indicator LED 22 or other indicating means. The operation of indicator LED 22 is under the control of processor 11. LED indicator 22 is programmed to visually indicate to the user when the button-held-time parameter reaches certain system-defined values. When such a value is reached, receipt by controller 50 causes it to perform a modified response. These visual indications allow the user of remote control device 10 to know (for example) that a button has been held for a sufficient length of time to place controller 50 into a modified operational state. An example of a visual indication performed by indicator LED 22 is the LED commencing flashing after the button has been held for a predetermined period of time.

Controller 50 (FIG. 2) includes a receiver module 52 for receiving, demodulating and decoding signal transmissions received from remote control device 10. Controller 50 also includes a processor 54 for executing suitable programmed operating software routines that are stored in a memory 56. The operating software of controller 50 controls, amongst other things, an actuator 58, that is in turn operatively connected to a garage door opener 60. The output of receiver 52/54 therefore determines whether actuator 58 is operated, The details of garage door opener 60 and its operation do not form part of the present invention and will thus not be described further herein Such devices are known to the skilled reader.

Receiver module 52 monitors the received button-held-time parameter and button-held indicator fields that are included in signal transmissions received from remote control device 10 Received signal transmissions also include an indication of the particular button on remote control device 10 that was pushed. The receiver receives this information within the transmitter button's transmission data and modifies its response to the transmitter button's unique code (ie. its output) based upon the field contents and the remote control function assigned to the transmitter button.

An example code setting operation that utilises remote control device 10 will now be described. During a code setting operation, controller 50 will only accept remote control device 10's unique code after the received button-held-time parameter reaches a specified value (such as 2 seconds) and the button-held indicator indicates that the button has been released. It will be understood that such an operation greatly reduces the risk of occurrence of an incorrect coding. This risk reduction arises from the fact that the button-held-time parameter provides a reliable indicator that the user has held the transmitter button for the required time, and the button-held indicator indicates that the button has been released. In this way, the use of the button-held indicator ensures that the button has actually been released, rather than interruption of reception between remote control device 10 and controller 50 (e. due to interference) being incorrectly interpreted as indicating button release.

Alternatively, or in addition, controller 50 can be configured by way of suitable software routines in memory 56 to implement the following additional functionality in order to improve the code setting process:

The first transmission received by controller 50 has a button-held-time parameter that indicates the button has just been pressed. This prevents a transmitter being coded when the button was already pressed prior to the receiver being ready for code setting. This is implemented by checking that the first button-held-time parameter is a count<2, ie. to confirm that the first packet has been received.

Each successive transmission received by controller 50 indicates an adjusted button-held-time parameter, such as an increased count (except for transmissions in which the button-held indicator indicates that the button has been released). This ensures that transmissions are being generated from a single continuous operation of the transmitter button and not from multiple activations in which transmissions containing a button-held indicator indicating the button has been released are not received.

Transmissions are received for each of the possible button-held-time parameter values between the first received transmission being received and the final transmission required for coding. This ensures that the transmitter is generating the correct button-held-time parameter values.

Transmissions with the greatest button-held-dine parameter value (highest count value) are received with and without the button-held indicator being set, in other words a 'clear' signal (button-held indicator indicating that the button has been released) is received with a button-held-time parameter matching the previous received value. This provides a check that the transmitter is generating valid button-held indicator states.

The last received button-held-time parameter has incremented by at least two counts since the first packet was received.

In addition, the code set method may require that transmissions are received from two consecutive button presses before controller 50 will accept remote control device 10's unique code. This further reduces the risk of coding to an unwanted remote control device. This is achieved by checking matching serial numbers, matching button identity, and incrementing rolling code counters. The first button press may be required to satisfy the above transmission requirements, while the packets received from the second button press may simply satisfy that the first button-held-time parameter is a count<2, ie. to confirm that the first packet has been received.

Remote control device 10 and controller 50 are particularly suited to performing the 'attended 'code set procedure discussed above, which involves the user following prompts displayed on a status indicator 62 (such as a touch screen). In the case of 'remote' code set procedures, where status indicator 62 may not be observable by the user, the user is nevertheless still able to determine when the transmission has been accepted by controller 50, by observing the length of time the transmitter button has been held, or through use of LED status indicator 22.

Further, the button-held feature of this invention may be used when using the transmitter during an installation phase in order to set door limits, When driving the door to the positions that the installer is to set as the open and closed limits, the reception of the a release state transmission is used as a positive indication to the garage door controller that the motor is to be stopped. This provides a more responsive system than hitherto possible.

The required button-held-time is a configurable system setting and may—at least in part—be dependent on whether other button-held-time responses are implemented. Typically the required button-held-time is significantly greater than that required for normal operation, but not so long as to be inconvenient to the user. However, overall, use of remote control device 10 and receiver 50 permits a shorter hold-time requirement that would otherwise be achievable, due to the reduced risk of coding an incorrect transmitter As an example, the concept may be used by a garage door owner selecting 'Vacation Mode' for their garage door opener, which has the effect of locking out all but one master transmitter, so does not allow the opener to be operated until the owner returns and deactivates Vacation Mode. A particular remote control button is coded to switch the opener to Vacation Mode, with the receiver requiring reception of a command signal and a button-held-time parameter corresponding to the relevant button being held for 2 seconds in order to enter Vacation Mode (to avoid inadvertent activation of this mode). To deactivate Vacation Mode, no such button-held-time parameter is required, the user simply needs to press the relevant button.

Remote control device 10 and controller 50 can be conveniently used to address the issue of toggle operation discussed above. Specifically, the issue can be addressed by controller 50 processing the button-held-time parameter and button-held indicator and performing a modified response based thereon. Suitable processing steps and modified responses include:

Receiver 52/54 compares the button-held-time parameter to a predetermined value (such as 2 seconds). If the time is less than 2 seconds then the receiver output is turned ON, otherwise if the button held time parameter exceeds 2 seconds, the receiver output is turned OFF.

As described above, except that receiver 52/54 does not operate its output until either the button-held-time parameter reaches 2 seconds, in which case it is turned OFF, or if the button-held indicator indicates the button has been released and the button-held-time parameter is less than 2 seconds, then the output is turned ON.

These processing steps and modified responses can also be conveniently used to activate or deactivate various modes of operation supported by controller 50 or garage door opener 60.

Another advantageous use for remote control device 10 and controller 50 is to indicate a user's desired intention, for example, to cause controller 50 to close a garage door. In this scenario, controller 50 can respond to an 'open' command from remote control device 10 on receipt of any appropriate signal (ie. any button-held-time parameter associated with the assigned button), but does not respond to a 'close' command from remote control device 10 until the button-held-time parameter reaches a prescribed minimum value (for example 2 seconds).

A modified form of this embodiment involves receiver 52/54 activating different commands based on the duration of the received button-held-time parameter. As an example, when the door is in a part-open position, operation of a door command button for less than a specified time (for example 2 seconds) opens the door, whereas operation for greater than the specified time doses the door.

As the transmitting module 16 generates transmissions after the button is released with the button-held indicator clear (ie. the transmissions include the flag indicating that the button has been released), receiver 52 is able to detect the button release without having to rely on a timeout feature (as required in the prior it which also has to compensate for receiver interference), to turn the output off.

Each transmission generated by transmitting module 16 utilises rolling code encryption to protect the contents of the transmitted packet. Also included within each transmitted packet (in addition to the button-held-time parameter and button-held indicator) are:

Unique serial number of transmitting module 16
Identity of button being pressed
Rolling code sequence counter
Payload Other data items can be included as required, for security or other purposes Modifications and improvements to the invention will be readily apparent to those skilled in the art, Such modifications and improvements are intended to be within the scope of this invention.

Further, it is to be understood that, throughout the description and claims of this specification, if and where the word 'comprise' appears (and variations of the word, such as 'comprising' and 'comprises), this is not intended to exclude other additives, components, integers or steps.

The invention claimed is:

1. A remote control device, comprising:

one or more command buttons, each of which, when operated, directly or indirectly generates a command signal;

a determination module for determining the length of time a command button is held to provide a button-held-time parameter; and a transmitter module that is configured to transmit the button-held-time parameter in association with the command signal, without the button-held-time parameter being used by the remote control device to make any determination of the command signal to be transmitted.

2. A remote control device according to claim 1, wherein the button-held-time parameter is a value modified after a prescribed time interval.

3. A remote control device according to claim 2, wherein the value is a count, sequentially incremented on regular intervals.

4. A remote control device according to claim 1, wherein the determination module is further configured to determine a button-held indicator indicating whether the command button has been released.

5. A remote control device according to claim 4, wherein the transmitter module is configured to transmit the button-held indicator in association with the command signal.

6. A remote control device according to claim 4, wherein the transmitter module is further configured to delay transmission of the button-held-time parameter on the basis of the state of the button-held indicator.

7. A remote control device according to claim 4, wherein the transmitter module is further configured only to transmit the button-held-time parameter if the button-held indicator indicates that the command button has been released.

8. A remote control device according to claim 4, wherein the button-held indicator is a single bit, indicating either 'button held' or 'button clear'.

9. A remote control device according to claim 4, wherein the transmitter module is further configured to continue transmitting signals for a period of time after the button-held indicator indicates that the command button has been released.

10. A controller comprising:

a receiver module for receiving and decoding signals transmitted from a remote control device, the signals including one or more commands and one or more button-held-time parameters, wherein the one or more button-held-time parameters identifies the length of time a command button is held; and an actuator module operatively connected to the receiver module, the actuator module being configured to implement selected functions on a controlled device, wherein the function selections are made on the basis of the received command(s) and button-held-time-parameter(s).

11. A controller according to claim 10, wherein the received signals further include a button-held indicator indicating whether a command button of the remote control device used to generate the command(s) has been released, the function selected by said actuator module being selected or modified on the basis of the button-held indicator.

12. A controller system comprising:

a remote control device comprising, one or more command buttons, each of which, when operated, directly or indirectly generates a command signal;

a determination module for determining the length of time a command button is held to provide a button-held-time parameter; and a transmitter module that is configured to transmit the button-held-time parameter in association with the command signal, without the button-held-time parameter being used by the remote control device to make any determination of the command signal to be transmitted;

and a controller comprising, a receiver module for receiving and decoding signals transmitted from a remote control device, the signals including one or more commands and one or more button-held-time parameters, wherein the one or more button-held-time parameters identifies the length of time a command button is held; and an actuator module operatively connected to the receiver module, the actuator module being configured to implement selected functions on a controlled device, wherein the function selections are made on the basis of the received command(s) and button-held-time-parameter(s);

wherein the remote control device and the controller are communicatively coupled.

* * * * *